United States Patent [19]

Crider, Jr.

[11] 4,134,479

[45] Jan. 16, 1979

[54] CARRY-ABOUT WARDROBE UNIT

[76] Inventor: Ira J. Crider, Jr., 16603 Norwood Dr., Minnetonka, Minn. 55343

[21] Appl. No.: 794,038

[22] Filed: May 5, 1977

[51] Int. Cl.[2] ..... A45C 3/00; A45C 13/00

[52] U.S. Cl. ..... 190/49; 190/52; 190/41 R; 211/71; 211/133; 312/323

[58] Field of Search ..... 190/49, 50, 41 B, 54, 190/51, 52; 312/323, 334, 338; 211/133, 71

[56] References Cited

U.S. PATENT DOCUMENTS

| | | | |
|---|---|---|---|
| 484,121 | 10/1892 | Stein | 312/334 |
| 1,804,069 | 5/1931 | Stover | 211/133 |
| 1,870,305 | 8/1932 | Wheary | 190/51 X |
| 2,016,520 | 10/1935 | Short | 150/49 |
| 2,422,511 | 1/1947 | Wolsey | 190/51 |
| 2,517,757 | 8/1950 | Adlerstein | 190/41 Z |
| 2,874,813 | 2/1959 | Bunte | 190/41 Z |
| 3,141,535 | 7/1964 | Hamilton | 190/49 |
| 3,448,839 | 6/1969 | Lugash | 190/49 |
| 3,899,101 | 8/1975 | Keating et al. | 220/241 |

FOREIGN PATENT DOCUMENTS

| | | | |
|---|---|---|---|
| 970794 | 9/1964 | United Kingdom | 211/133 |

*Primary Examiner*—William Price
*Assistant Examiner*—Joseph Man-Fu Moy
*Attorney, Agent, or Firm*—Stuart R. Peterson

[57] ABSTRACT

A case is provided with clips at the top and bottom so that it is releasably secured to upper and lower portions of a frame, thereby permitting the case to be readily removed. A suit coat can be readily draped over the top of the frame, which is configured much like a garment hanger. A horizontal rack near the bottom of the frame supports shoes beneath the case. Interlocking pivotal pants bars enable trousers to be carried. A flexible cover provided with shoulder and hand straps encloses the frame, case, suit coat, trousers and shoes.

8 Claims, 5 Drawing Figures

CARRY-ABOUT WARDROBE UNIT

BACKGROUND OF THE INVENTION

1. Field of the Invention

This invention relates generally to luggage, and pertains more particularly to a wardrobe unit that enables the traveler to carry it onto planes and the like.

2. Description of the Prior Art

Suitcases, of course, are notoriously old. Although some are designed to be carried aboard planes, most must be checked. Those that can be carried usually are not suitable for transporting suits. Consequently, they are largely intended, and used, for trips of relatively short duration.

Garment bags are equally old and widely employed. However, a garment bag is usually intended just for a suit and not for other articles. Therefore, when using a garment bag the traveler frequently must also resort to carrying some sort of suitcase also.

One attempt with which I am acquainted that attempts to combine the features of both a small suitcase or carry-on hand luggage with the utility of a garment bag is the luggage described in U.S. Pat. No. 3,448,839, granted on June 10, 1969, to Max J. Lugash. The principal difficulty with the luggage described in the aforesaid patent is that the coat hanger is integral with the case, thereby making it very awkward to pack. Not only does the suit coat normally have to be removed in order to gain access to the case, but the case must always be used when traveling, for it is an integral part of the luggage, providing the means for hanging the suit coat. In other words, the user cannot omit the case and use the garment bag portion of the combination to carry just a suit, for there would be no coat hanger on which to hang the suit coat.

SUMMARY OF THE INVENTION

A general object of my invention is to provide a carry-about wardrobe unit that is completely versatile in that it affords the traveler with the capability of transporting everything that he is apt to require on a given trip, ever if the trip is of a week's duration.

A more specific object of my invention is to provide a wardrobe unit of the carry-on type utilizing a removable inner case that can be easily packed and unpacked.

Another object of the invention is to permit the traveler to use the garment portion of the wardrobe unit without the case, so that he can at times carry only a suit if the requirements of a given trip so dictate.

Yet another object of the invention is to provide a portable wardrobe unit that is quite compact and which can be easily carried aboard planes and conveniently stowed on the plane where space is usually quite limited. Consequently, a traveler can not only carry all of the items required for his trip but will be assured that the wardrobe unit will not be lost, misdirected or mishandled, all with the benefit of saving time by not having to wait for checked luggage to be unloaded and delivered to the baggage area upon arrival.

Still further, an object is to provide a carry-about type of wardrobe unit that will be quite lightweight and relatively low cost, thereby encouraging its widespread use.

Still another object is to provide luggage that is intended to be carried onto aircraft and which can be easily opened for inspection unpon request by airport security personnel.

Another object of the invention is to provide a portable wardrobe unit that can not only be readily carried by the user himself but also by porters and bellhops, particularly with respect to standing the unit on the floor with a portion leaning against a wall when not actually being carried.

Briefly, my invention contemplates a portable wardrobe unit that can be carried from place to place very easily, and particularly onto planes so that the unit is immediately available at the traveler's destination. A frame is configured so that a suit coat can be draped over the upper portion thereof. The frame forms a rectangular opening into which fits a removable or detachable case, there being clips at the top and bottom of the case which easily release the case so that it can be completely removed from the frame. Provision is made for accommodating trousers. Also, shoes can be stored without having to place the shoes within the case itself. The case in this way can be reserved for items that must remain clean, such as shirts, underwear, pajamas and socks, as well as miscellaneous toilet articles. Provision is made for hanging the wardrobe unit on any conventional overhead rack; the frame can remain hanging even after the case has been removed.

DESCRIPTION OF THE PREFERRED EMBODIMENT

Figure 1:
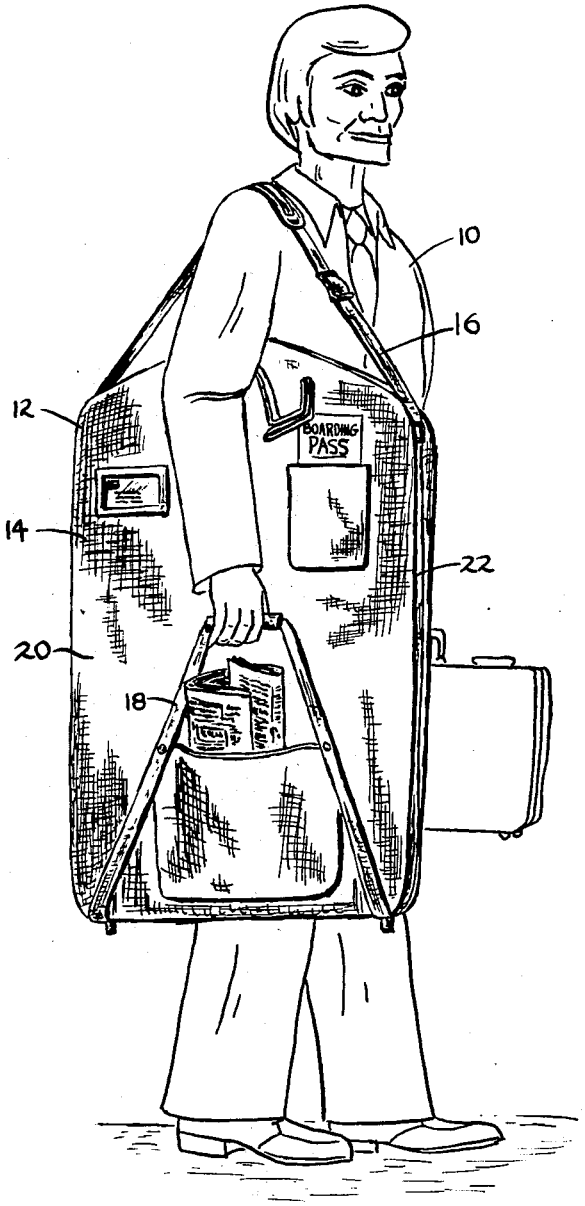
FIG. 1 is a view showing my wardrobe unit being carried by a traveler.

Referring first to FIG. 1, a traveler 10 has been pictured while using my wardrobe unit which has been denoted generally by the reference numeral 12. The wardrobe unit 12 includes a flexible cover 14 provided with a shoulder strap 16 and a hand strap 18. The cover 14 has a front flap 20 provided with zippers 22 and 24 at each side. More specifically, the zippers 22 and 24 are each provided with intermeshing tracks *22a, 22b* and *24a, 24b,* respectively as can be discerned in FIG. 2, there being a slide *22c* for the zipper 22 and a similar slide (not visible) for the zipper 24.

Figure 2:
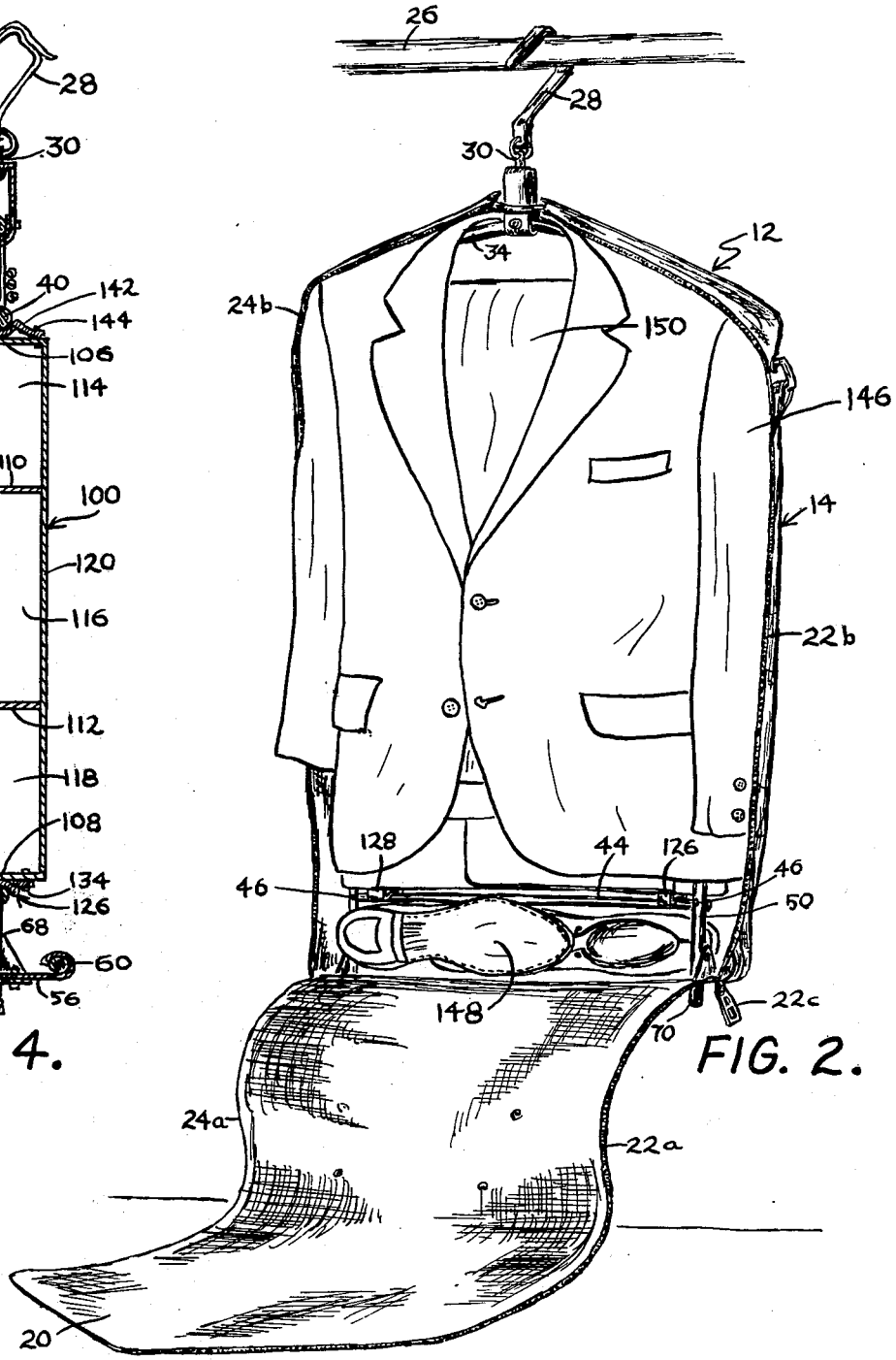
FIG. 2 is a perspective view of the wardrobe unit while hanging from an overhead rack, the front flap of the flexible cover having been unzipped in order to show how certain items are packed.

In FIG. 2, my wardrobe unit 12 is illustrated as hanging from an overhead bar or rack 26. In this regard, the hook 28 has a swivel at 30 by means of which a frame 32 is suspended. More specifically, the swivel 30 is attached to the apex of an angled top rod 34 having a coat hanger configuration imparted thereto. The hanger rod 34 is integral in the illustrated construction with spaced vertical rods 36 and 38. Extending beneath the hanger 34 is a horizontal upper rod 40 having rivets 42 which anchor it to the spaced vertical rods 36 and 38. Similarly, a lower horizontal rod 44 has its ends anchored to the spaced vertical rods 36 and 38 by means of rivets 46. The spaced vertical rods 36 and 38, together with the upper and lower rods 40, 42, form a rectangular opening 48.

The rods 36, 38 have portions 50 and 52, respectively, extending downwardly therefrom to a rectangular shoe rack or support 54. The rack 54 has a pair of plate-like members 56 and 58 extending thereacross, the ends of these members 56, 58 being looped at 60 so as to fasten the two members to the rack 54. Angled brackets 62 and 64 have their horizontal portions fastened to the attaching plates 54, 56 by means of rivets 66, whereas the upwardly directed portions of the brackets 62, 64 are fastened to the extensions or legs 50, 52 through the agency of additional rivets 68. The extensions 50, 52 terminate in legs or feet 70 and 72.

It will be appreciated that the frame 32 can be fabricated entirely from aluminum. All of the rods that have been referred to can be tubular, thereby further decreasing the overall weight of the frame 32.

At this time attention is directed to a pair of pants bars or arms 74 and 76. The pants bar 74 has a looped end 80 which pivotally connects it to the vertical rod 36; it has a hooked or free end 82. In a generally similar manner, the pants bar 76 has a looped end 84 which pivotally connects the bar 76 to the vertical rod 38; it has a hooked or free end 86 plus offset intermediate portions 88, 90 so that when the hook ends 80 and 86 of the bars 74, 76 are engaged, the offset portions 88 and 90 receive therein straight portions of the bar 74.

Playing an important role with respect to my invention is a removable case denoted in its entirety by the reference numeral 100. It includes side walls 102 and 104 as well as a top wall 106 and a bottom wall 108. In the embodiment shown in FIG. 5, it will be perceived that two dividers or partitions 110 and 112 are employed so that three compartments 114, 116 and 118 are provided. There is a back or rear wall 120. Capable of closing the front is a pair of hinged panels or flaps 122 and 124. As best viewed in FIG. 3, a pair of quarter-turn fasteners 125 are employed to hold the flaps 122, 124 closed.

Figure 4:
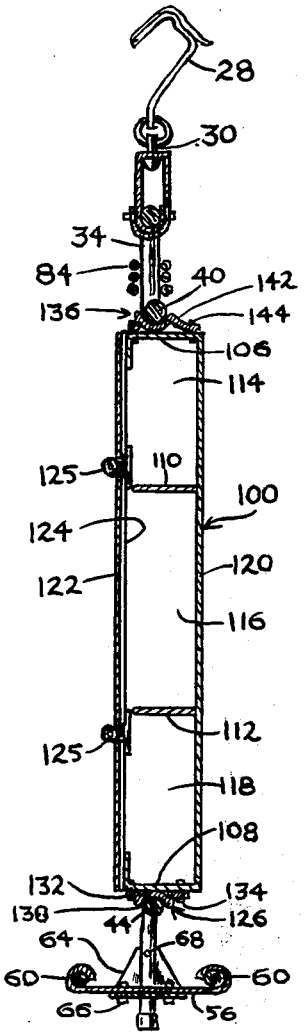
FIG. 4 is a sectional view taken in the direction of line 4—4 of FIG. 3.
Figure 5:
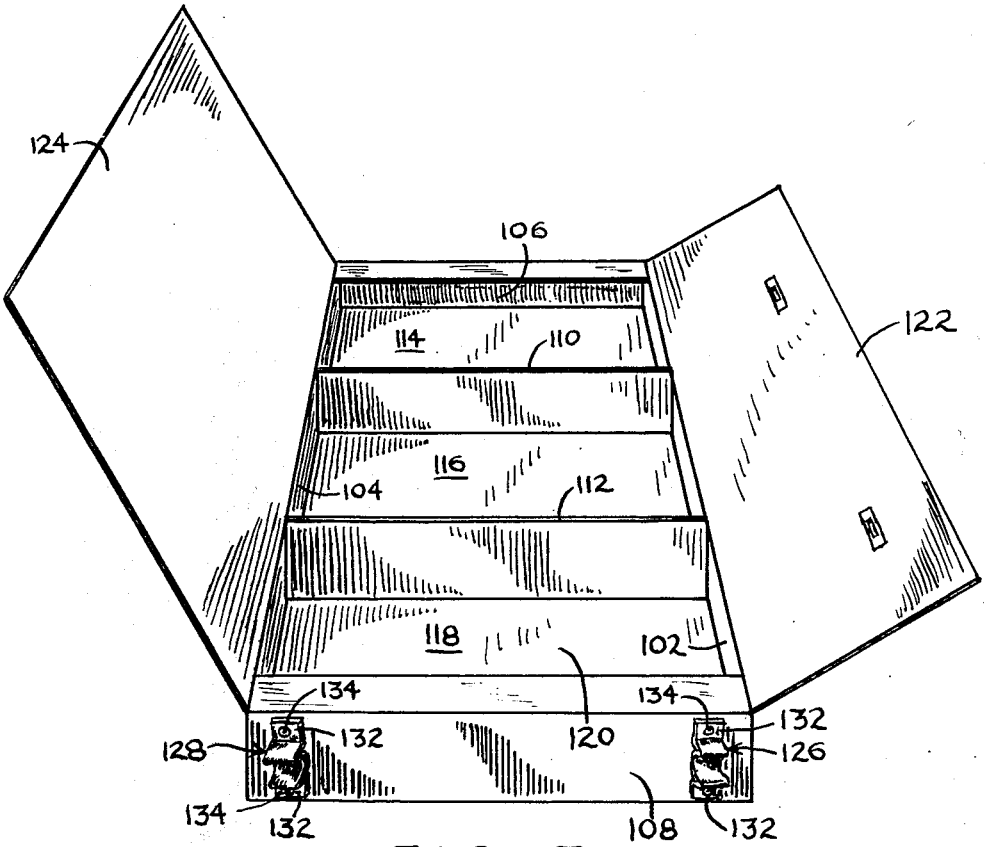
FIG. 5 is a perspective view of the case with the flaps open, the view being taken in the direction of the bottom so as to show two of the four clips used in releasably securing the case to the frame.

A pair of clips 126, 128 are attached to the bottom wall 108, as can be seen in FIG. 5, each having a notch or groove 130 (See FIG. 4) for receiving therein spaced portions of the lower rod 44. Wings 132 enable rivets 134 to be employed, the rivets 134 fasten and hold the clips 126, 128 in place on the bottom wall 108.

Figure 3:
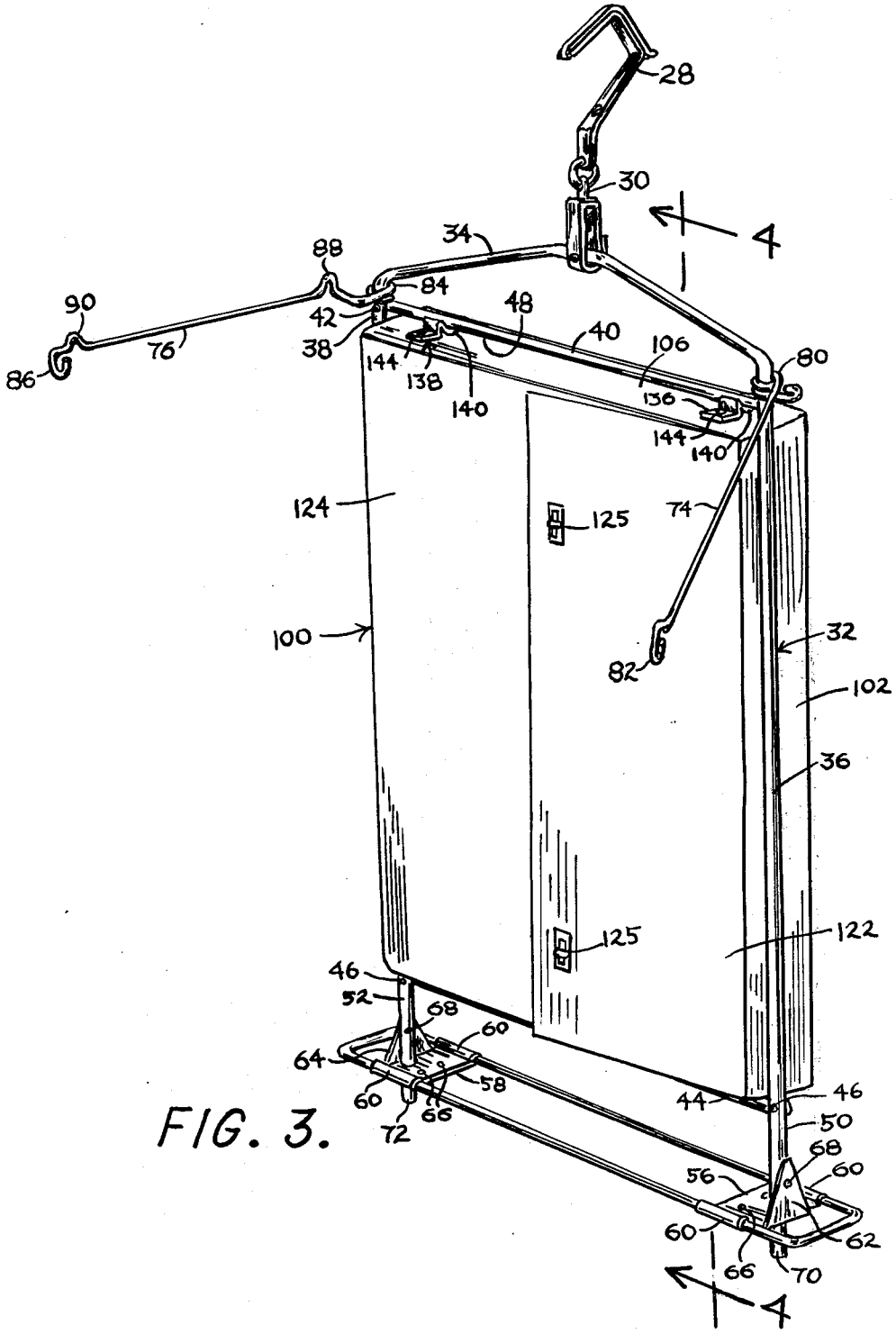
FIG. 3 is a perspective view of the frame and case with the flexible cover removed.

A pair of clips 136 and 138 are attached to the top wall 106, as best seen in FIG. 3. The clips 136, 138 have a notch or groove 140 (FIG. 4) for the accommodation of spaced portions of the upper rod 40. Each clip 136, 138 is formed with an inclined ramp 142 (FIG. 4) which, owing to the resiliency of the clips 136, 138 enables the case 100 to be inserted in the rectangular opening 48 by first engaging the bottom clips 126 and 128, more specifically, their notches 130, with the lower rod 44. The clips 136, 138 are fastened to the top wall 106 via rivets 144.

It will be assumed that the case 100 is initially angled to the left from the position in which it appears in FIG. 4. When swung about the lower rod 44 in a clockwise direction, it can be appreciated that the ramp portions 142 of the upper clips 136, 138 ride under the upper rod 40. By reason of the resiliency of the upper rod 40 and the resiliency of the clips 136 and 138, the upper rod 40 readily passes into the notches 138, this condition being shown in FIGS. 3 and 4. Thus, the case 100 is releasably secured within the rectangular opening 48.

Although the utility of my portable wardrobe unit 12 should be readily appreciated from the preceding information, nonetheless, as illustrated in FIG. 2, a suit coat 146 is draped over the angled top or hanger 34. In the space beneath the case 100 are placed a pair of shoes 148. Over the pants bars 74, 76 are placed a pair of trousers 150. Although the miscellaneous items that can be carried in the compartments 114, 116 and 118 are not shown, it will be recognized that the compartment 114, say, can carry several shirts, the compartment 116 socks and underwear, as well as pajamas, and the remaining compartment 118 the various toilet articles that a traveler would normally expect to carry with him.

It is very important to recognize that my wardrobe unit 12 possesses a high degree of versatility. The case 100 can be easily disengaged from the frame 32 by simply pulling the top thereof in a counterclockwise direction as viewed in FIG. 4, this causing the upper clips 136, 138 to ride under the upper rod 40. Once swung in a sufficient angle so that the top wall 106 clears the rod 40, the user only need lift the case 100 completely out of the opening 48. He can then place the case 100 on any horizontal surface, such as a bed or dresser, much in the fashion appearing in FIG. 5. It will be recognized that the pants bars 74 and 76 might very well require swinging into their open or disengaged condition as shown in FIG. 3 in order to remove the case 100. The trousers 150 can remain on one of the bars 74 or 76, however. The suit coat 146 does not have to be removed from the angled hanger rod 34, though.

Inasmuch as the case 100 can be readily removed, it need not be used at all. This leaves the user with just the frame 32 and the flexible cover 14. He can then carry the coat 146 and pants 150 in a fashion resembling that in which they would be transported with a conventional garment bag.

When removing the case 100, such as when the traveler reaches a hotel, he does not have to take off the suit coat 146, for access to the case 100 can be made without removal of the coat 146. As a matter of fact, if he has packed the articles for the case 100 carefully, he can even obtain access to the several compartments 114, 116 and 118 while the wardrobe unit 12 is hanging by the hook 28 from the bar or rack 26, which is conventionally provided in most closets.

I claim:

1. A carry-about wardrobe unit comprising a frame having a lower and an upper end over which a suit may be draped, said frame including a single upper rod adjacent said upper end, a single horizontal lower rod adjacent said lower end, a single first side rod connected to one end of said upper rod and connected to one end of said lower rod and a single second side rod connected to the other end of said upper rod and to the other end of said lower rod, said first and second rods extending between said upper and lower rods, a generally rectangular case for containing miscellaneous articles therein, said upper, lower and side rods forming a generally rectangular opening and said case being receivable in said opening, said case including a top end wall, a bottom end wall, parallel side walls, a rear wall and a front closure means with said top and bottom walls being spaced a lesser distance than said upper and lower rods and said side walls being spaced a lesser distance than said first and second side rods whereby said case substantially fills said rectangular opening, and said top end wall, said bottom end wall and said parallel side walls being wider than said upper, lower, first and second side rods so that said rear wall and said front closure means of said case reside forwardly and rearwardly, respectively, from said rods, means fastened to said top wall of said case and spaced from both said rear wall and said front closure means for releasably engaging said upper rod, means fastened to said bottom wall and spaced from both said rear wall and said front closure means for releasably engaging said lower rod, an angled hanger rod having its opposite end connected to the upper ends of said first and second side rods, said angled hanger rod having a central apex, and a single hook attached to said angled top rod at said apex, whereby said frame may be hung by means of said single hook.

2. A carry-about wardrode unit in accordance with claim 1 including a flexible cover enclosing said frame and case.

3. A carry-about wardrobe unit in accordance with claim 1 in which said first and side rods have portions thereof extending downwardly beyond said lower rod, the lower end of each extending portion forming a supporting foot for said frame.

4. A carry-about wardrobe unit in accordance with claim 3 including a shoe rack attached to said extending portions intermediate said lower rod and said feet, said shoe rack having a length generally corresponding to the distance between said first and second vertical side rods and a width corresponding generally to the width of said bottom wall.

5. A carry-about wardrobe unit in accordance with claim 1 in which the means on said top wall includes a pair of spaced elements having grooves for accommodating therein spaced portions of said upper rod and in which said means on said bottom wall includes a pair of spaced elements having grooves for accommodating therein spaced portions of said lower rod.

6. A carry-about wardrobe unit in accordance with claim 5 in which said elements on said top wall each have a ramp for guiding said upper rod into the grooves of said upper elements.

7. A carry-about wardrobe unit in accordance with claim 6 in which each of said elements on said top wall constitutes a resilient clip affixed to the top wall of said case.

8. A carry-about wardrobe unit in accordance with claim 2 in which said cover includes a flap and zipper for closing said cover flap.

* * * * *